US005533479A

United States Patent [19]

Wild et al.

[11] Patent Number: 5,533,479

[45] Date of Patent: Jul. 9, 1996

[54] METHOD AND SYSTEM FOR A FUEL TANK VENTILATION

[75] Inventors: Ernst Wild, Oberriexingen; Werner Mezger, Eberstadt, both of Germany

[73] Assignee: Robert Bosch GmbH, Stuttgart, Germany

[21] Appl. No.: 507,261

[22] PCT Filed: Dec. 20, 1994

[86] PCT No.: PCT/DE94/01531

§ 371 Date: Aug. 18, 1995

§ 102(e) Date: Aug. 18, 1995

[87] PCT Pub. No.: WO95/17593

PCT Pub. Date: Jun. 29, 1995

[30] Foreign Application Priority Data

Dec. 21, 1993 [DE] Germany ..... 43 43 654.4

[51] Int. Cl.[6] ..... F02M 33/02

[52] U.S. Cl. ..... 123/520

[58] Field of Search ..... 123/339.14, 339.23, 123/518, 519, 520

[56] References Cited

U.S. PATENT DOCUMENTS

| | | | |
|---|---|---|---|
| 4,926,825 | 5/1990 | Ohtaka et al. | 123/520 |
| 4,961,412 | 10/1990 | Furuyama | 123/520 |
| 5,005,550 | 4/1991 | Bugin, Jr. et al. | 123/520 |
| 5,172,672 | 12/1992 | Harada | 123/519 |
| 5,174,265 | 12/1992 | Sekine | 123/520 |
| 5,203,300 | 4/1993 | Orzel | 123/339.23 |
| 5,371,412 | 12/1994 | Iwashita et al. | 123/519 |

*Primary Examiner*—Thomas N. Moulis
*Attorney, Agent, or Firm*—Edwin E. Greigg; Ronald E. Greigg

[57] ABSTRACT

In a method and a system for the ventilation of a fuel tank of a motor vehicle having an internal-combustion engine which has a suction pipe with a bypass containing, in particular, an idling adjuster, the fuel tank being capable of being ventilated into the open by way of a ventilation conduit having an adsorption filter and having a first valve located between the latter and a ventilation orifice, and the adsorption filter being capable of being scavenged with scavenging air which is supplied to the suction pipe by way of a scavenging-air conduit containing a second valve, to avoid disturbances of the operating conditions of the internal-combustion engine the scavenging air for the adsorption filter is branched off from the airstream flowing by way of the bypass.

8 Claims, 7 Drawing Sheets

METHOD AND SYSTEM FOR A FUEL TANK VENTILATION

STATE OF THE ART

The invention relates to a method for the ventilation of a fuel tank of a motor vehicle having an internal-combustion engine and to a tank ventilation system for carrying out the method.

A method of the relevant generic type for the ventilation of a fuel tank and a tank ventilation system for carrying out this method are known (see, for example, Bosch, Technische Unterrichtung [Technical Information], Motronic, 2nd edition, September 1985, page 26, 27, 35). In the known method and the known ventilation system, the scavenging of the adsorption filter is carried out by means of a scavenging-airstream which flows from the atmosphere through the adsorption filter by way of a ventilation orifice and a shut-off valve opened for the scavenging operation and which, by way of a tank ventilation valve opened for the scavenging operation, is introduced, downstream of the throttle flap and of the bypass bypassing the throttle flap and conventionally containing an idling adjuster, into the suction pipe leading to the internal-combustion engine.

It has been shown that this known ventilation method and the known tank ventilation system do not in all cases fully meet the requirements. In particular, the scavenging-airstream, which must contain considerable air quantity per unit time for the effective scavenging of the adsorption filter, constitutes, in relation to the metered air quantity sucked in by way of the suction pipe, an appreciable leakage stream which leads to a lambda fault when the internal-combustion engine is working. In addition, when there is a high gas content in the tank, an additional fuel quantity is fed to the suction pipe along with the scavenging air and can impair the optimization of the operating conditions of the internal-combustion engine.

Proceeding from the state of the art and from the problem indicated above, the object on which the invention is based is to specify an improved method for the ventilation of a fuel tank of a motor vehicle and an improved tank ventilation system, by means of which a disadvantageous impairment of the regulated mixture composition for an internal-combustion engine during the scavenging of the absorption filter is avoided.

The set object is achieved by means of a method as set forth herein and the tank ventilation system set forth hereinafter.

ADVANTAGES OF THE INVENTION

An important advantage of the method according to the invention is that the scavenging-airstream enters the suction pipe as a measured leakage stream, since it is branched off from the measured airflow in the suction pipe and in the bypass of the latter, so that an impairment of the set operating parameters for the internal-combustion engine by an additionally supplied scavenging-air quantity is avoided under all operating conditions.

In an embodiment of the method according to the invention, there is additionally the possibility, when the gas content of the tank is high, of throttling the scavenging-air quantity in such a way that the fuel component contained in the scavenging-airstream likewise does not lead to any impairment of the regulated fuel/air mixture supplied to the internal-combustion engine.

As regards the tank ventilation system for carrying out the method according to the invention, there is, furthermore, the important advantage that, besides the two valves already required according to the state of the art, namely the shut-off valve downstream of the ventilation orifice for the adsorption filter and the ventilation valve in the ventilation conduit for the tank, no additional valves are required. On the contrary, it is sufficient to replace these two valves by conventional commercially available controllable valves which are available relatively cheaply.

BRIEF DESCRIPTION OF THE DRAWINGS

Further particulars and advantages of the invention are explained in more detail below by means of drawings. In these.

DETAILED DESCRIPTION OF THE EXEMPLARY EMBODIMENTS

Figure 1:
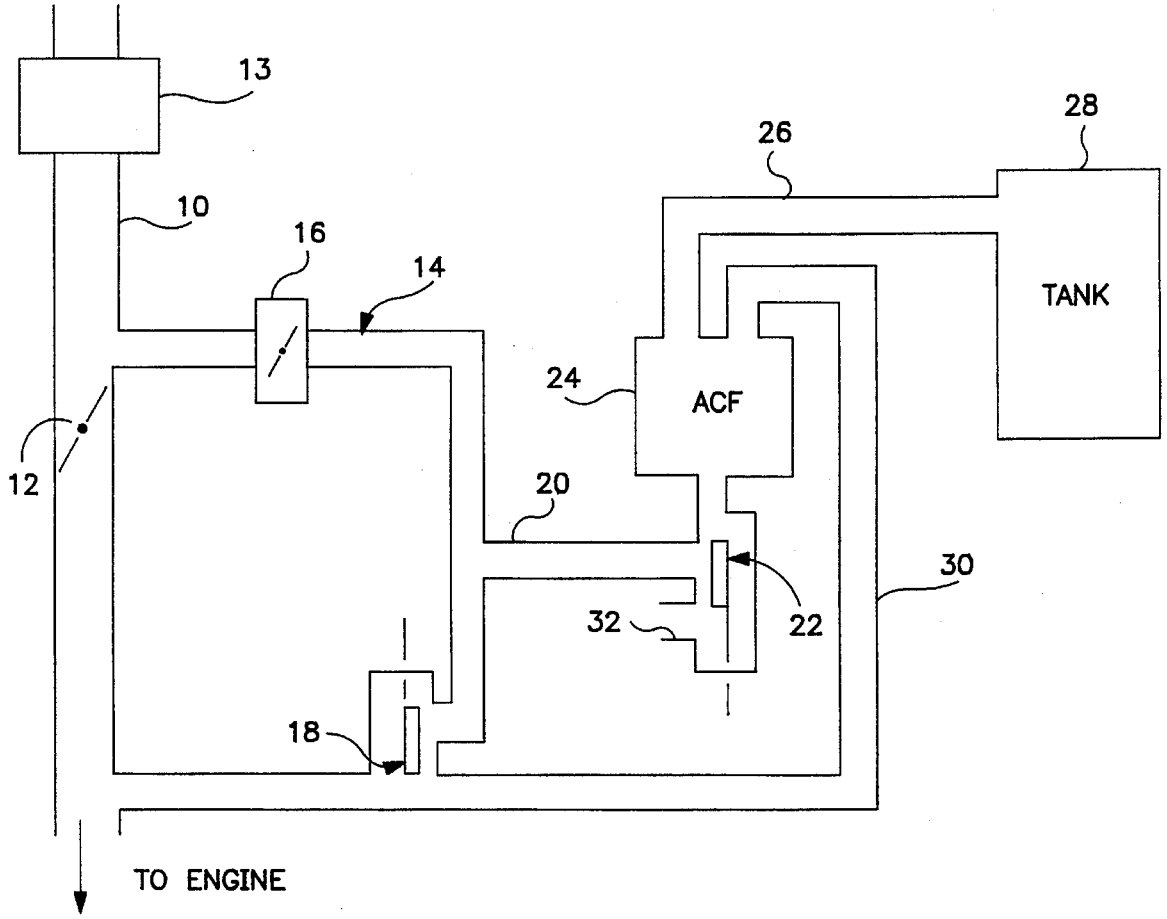
FIG. 1 shows a schematic diagram of a preferred embodiment of a tank ventilation system for carrying out the method according to the invention.

In detail, FIG. 1 shows a suction pipe 10, in which are arranged, upstream of a throttle flap 12 serving as a throttle member, an air-meter member 13*a* known type, for example a flap-type air meter, a hot-film sensor or the like, of a fuel-injection system not shown in any more detail. The measurement of the intake-air quantity can also be carried out by means of suction-pipe pressure measurement downstream of the throttle flap 12. A bypass 14, in which an idling adjuster 16 is arranged, is provided parallel to the portion of the suction pipe 10 equipped with a throttle flap. Normally, that is to say, in a conventional system, the bypass 14 or the bypass conduit leads directly back into the suction pipe downstream of the throttle flap 12, since, when the throttle flap 12 is closed, the bypass has the sole function of limiting the air quantity flowing to the internal-combustion engine (not shown) downstream of the throttle flap 12 to the air quantity set by the idling adjuster 16.

In contrast to the conventional system discussed above, in the tank ventilation system according to FIG. 1 there is inserted into the bypass 14 downstream of the idling adjuster 16 a tank ventilation valve 18 (regenerating valve) which, in the exemplary embodiment, is designed as a controllable valve assuming any intermediate position between a position completely shutting off the bypass 14 and a position completely opening the bypass 14. Between the idling adjuster 16 and the tank ventilation valve 18, there branches off from the bypass 14 a scavenging conduit 20 which serves for scavenging and which, by way of a shut-off valve 22, likewise designed as a controllable valve assuming any intermediate position between a position completely shutting the scavenging conduit 20 and a position completely opening the conduit 20, leads to an adsorption filter 24 which is designed, in particular, as an activated-charcoal filter. The adsorption filter 24 is connected to a fuel tank 28 by way of a connecting conduit 26. By means of a further conduit 30, the adsorption filter 24 is connected for scavenging, by way of the tank ventilation valve 18, to the downstream end of the bypass conduit or the suction pipe 10. Finally, a further connection of the shut-off valve 22 is connected to the atmosphere by way of a ventilation orifice 32.

The mode of operation of the tank ventilation system according to FIG. 1 is explained in more detail below for various typical operating states or operating conditions by means of FIGS. 2 to 7.

Figure 2:
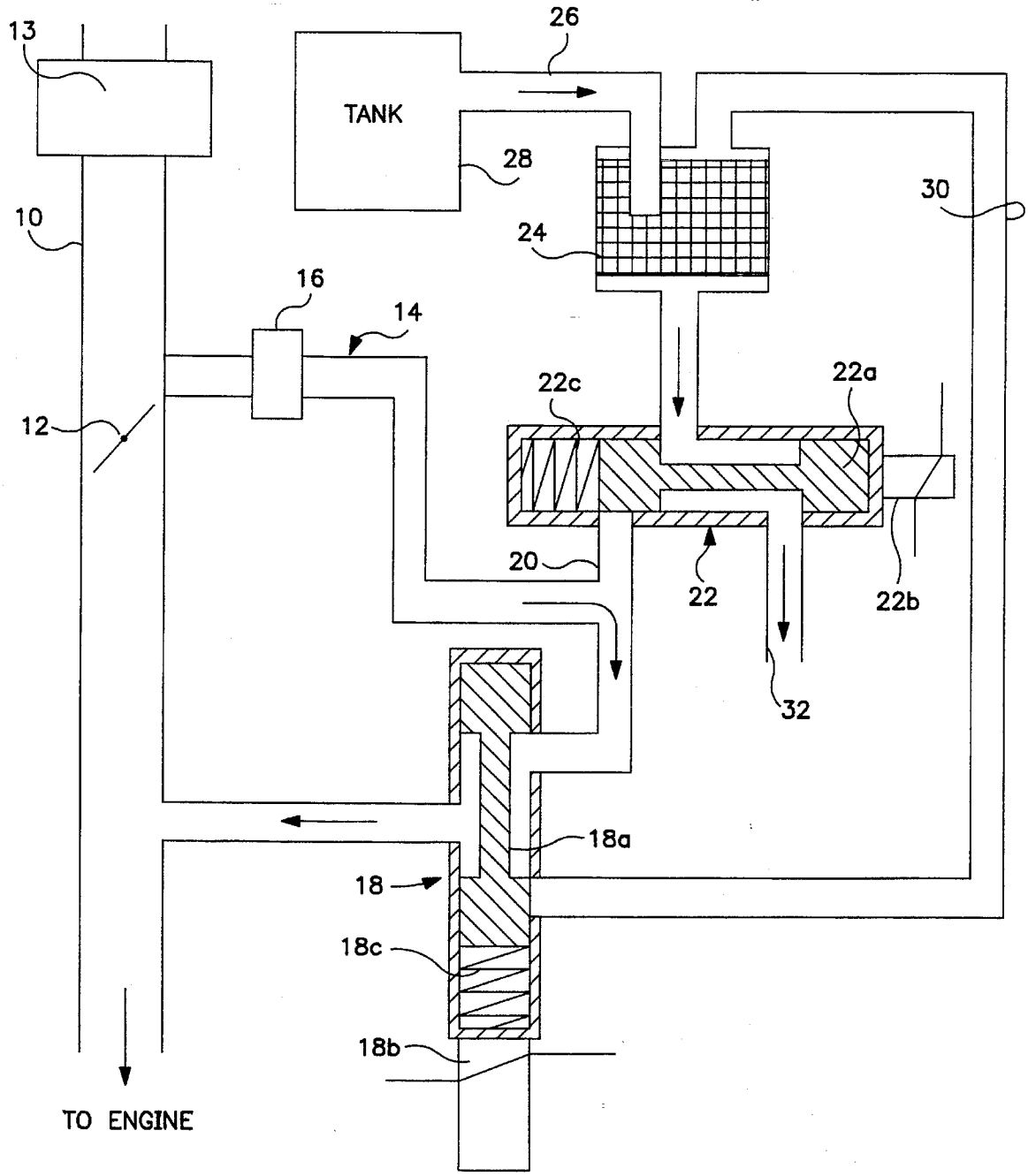
FIGS. 2 to 7 show, in respect of the valves, more detailed representations of the tank ventilation system according to FIG. 1 for some typical operating states.

In particular, FIG. 2 relates to an operating state, in which the two valves 18, 22 assume their position of rest, their valve elements 18*a*, 22*a*, when their respective exciting windings 18*b* and 22*b* are currentless, being located in the position shown in FIG. 2, in which they are held by the pretension of diagrammatically indicated spring elements 18*c* and 22*c*. As indicated by the flow arrows in the various ducts or conduits, this currentless state of the valves 18, 22 results in a complete separation between the suction pipe 10 and bypass 14, on the one hand, and the tank 28, the activated-charcoal filter 24 and tank ventilation, on the other hand. The tank ventilation valve 18 is fully opened in relation to the bypass conduit 14, and the combustion airstreams predetermined by the throttle flap 12 or the idling adjuster 16 flow by way of the suction pipe 10 and the bypass 14. When the exciting winding 18*b* is excited, the tank ventilation valve 18, which completely shuts off the conduit 30 in its position of rest, opens the conduit 30 in each intermediate position up to a complete opening. Coupled to an opening movement of this type, at the same time the bypass 14 is conversely closed increasingly. On the other hand, the tank 28 is connected to the orifice 32 by way of the filter 24 and the valve 22 opened for the waste air from the tank, whilst the valve 22 at the same time shuts off the conduit 20 between the bypass 14 and filter 24. Thus, when the gas content in the tank 28 is high, the fuel vapors are adsorbed in the filter 24, and the waste air passes into the atmosphere by way of the valve 22 and the orifice 32. The fuel component in the waste air is dependent in this case on the effectiveness and state of the adsorption filter 24. Correspondingly, when a negative pressure occurs in the tank 28, fresh air is sucked in from the atmosphere by way of the orifice 32.

Figure 3:
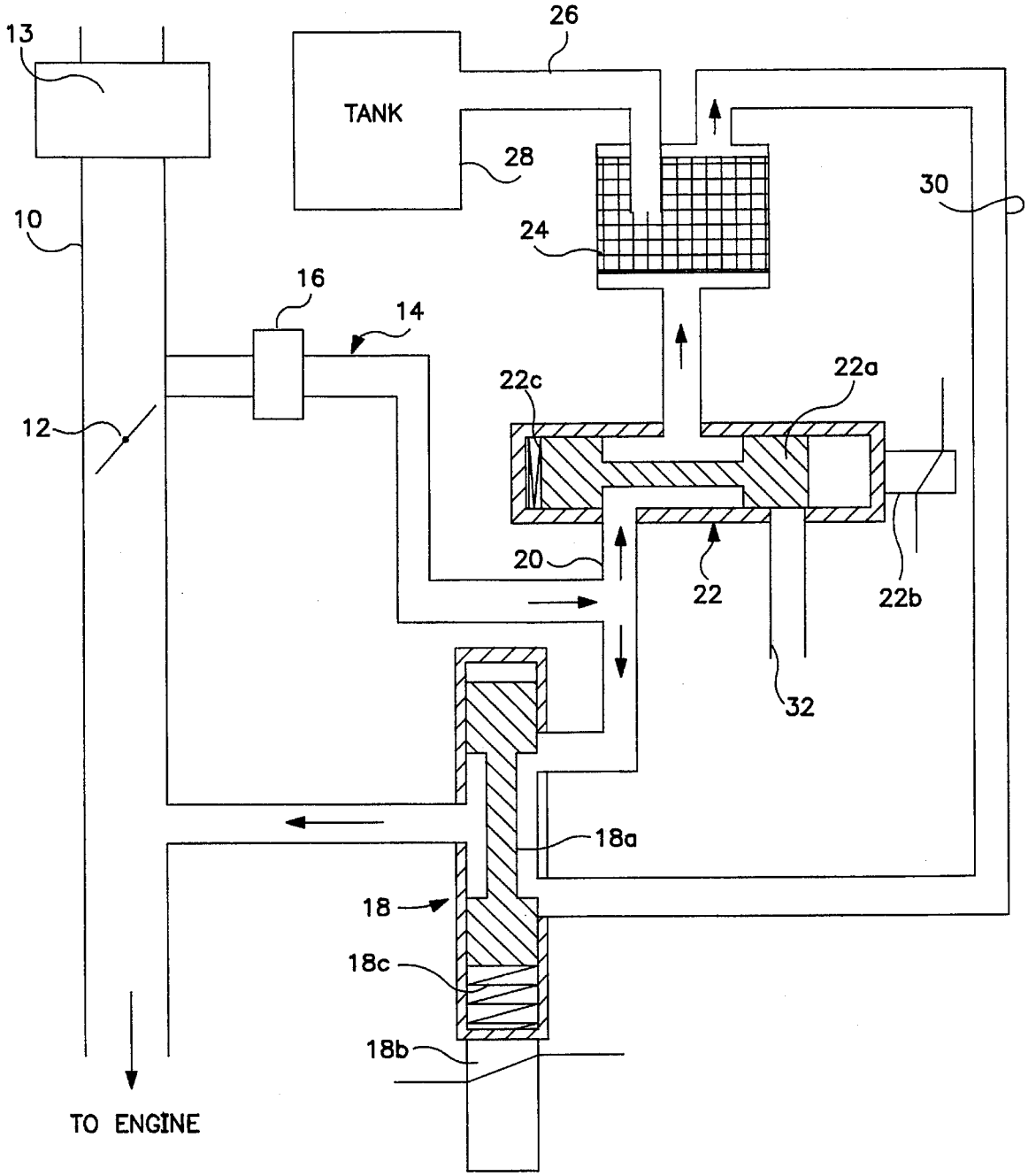

When the tank ventilation system is operating normally, the valve elements 18*a* and 22*a* of the valves 18 and 22 are located in an intermediate position, shown in FIG. 3, which is brought about by a corresponding control excitation of the exciting windings 18*b* and 22*b* of the valves 18 and 22, conventionally by means of a timed feed current. At the same time, the shut-off valve 22 completely opens the conduit 20 to the adsorption filter 24 and completely shuts off the connection to the ventilation orifice 32. In contrast, the tank ventilation valve 18 assumes a position, in which the bypass 14 and the conduit 30 are each partially opened.

In this intermediate position of the valve elements 18*a*, 22*a* of the valves 18, 22, as shown in FIG. 3, the airflow in the bypass 14 is divided, downstream of the idling adjuster 16, into two part streams, one of which flows by way of the valve 18 to the outlet-side end of the bypass conduit or to the suction pipe 10, whilst the other flows as a scavenging-airstream by way of the valve 22 to the adsorption filter 24 and, after passing through the filter 24, arrives via the conduit 30 at a further connection of the three-way valve 18, at the outlet of which the two inlet-side flows are then combined again and conveyed into the bypass 14, in order to be fed into the suction pipe 10 again downstream of the throttle flap 12.

It becomes clear from the representation according to FIG. 3 that a decisive advantage of the method according to the invention and of the tank ventilation system under consideration lies in the fact that the necessary scavenging air for regenerating the adsorption filter 24 is not sucked in from outside entering the suction pipe 10 in addition to the air quantity metered by the throttle flap 12 and the idling adjuster 16, but is branched off only downstream of the idling adjuster 16, that is to say at a point at which the air quantity for the internal-combustion engine connected to the suction pipe 10 is already measured, conveyed through the filter 24 and then introduced into the suction pipe 10 again together with the remaining air flowing by way of the bypass 14.

Figure 4:
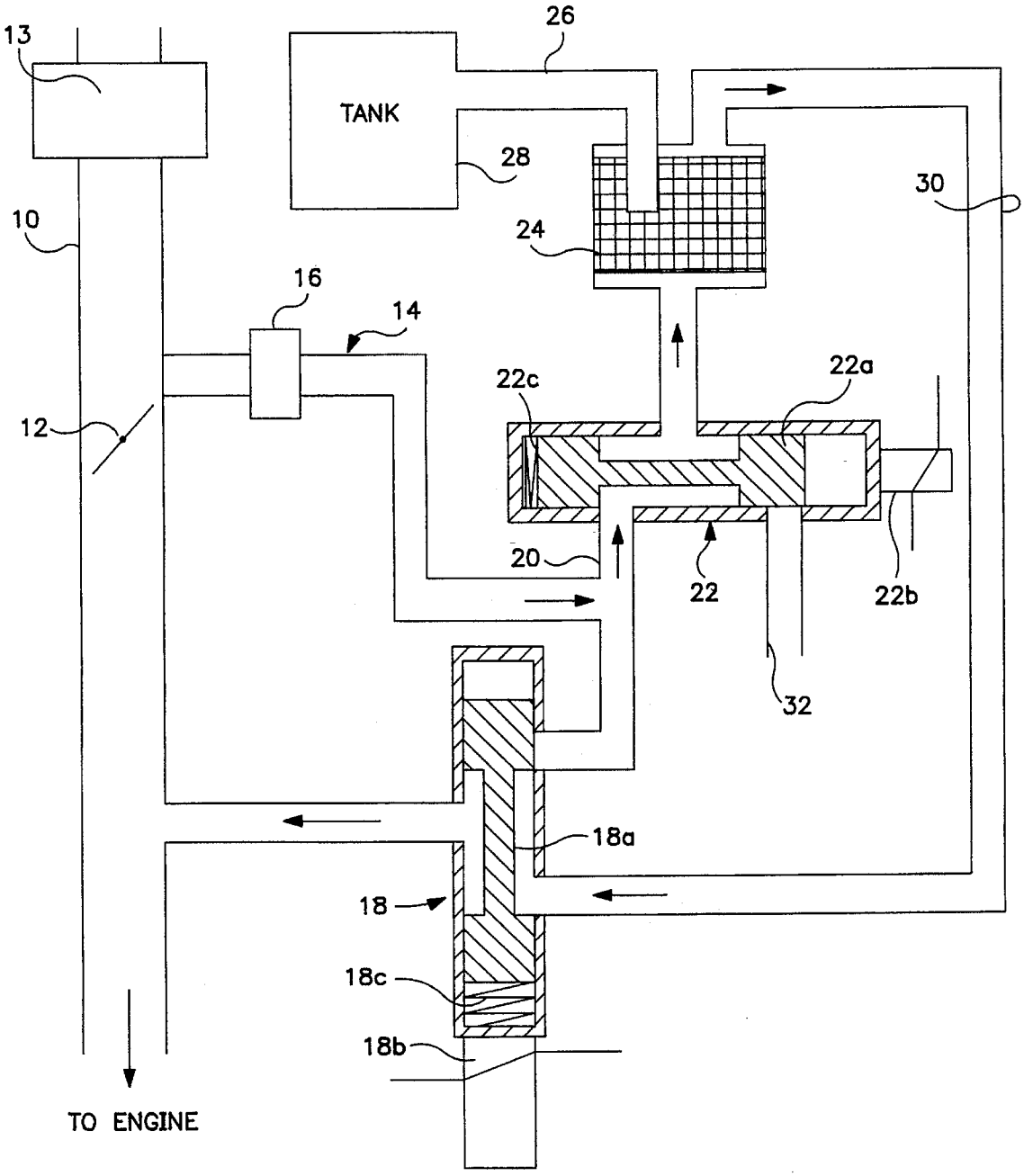
Figure 5:
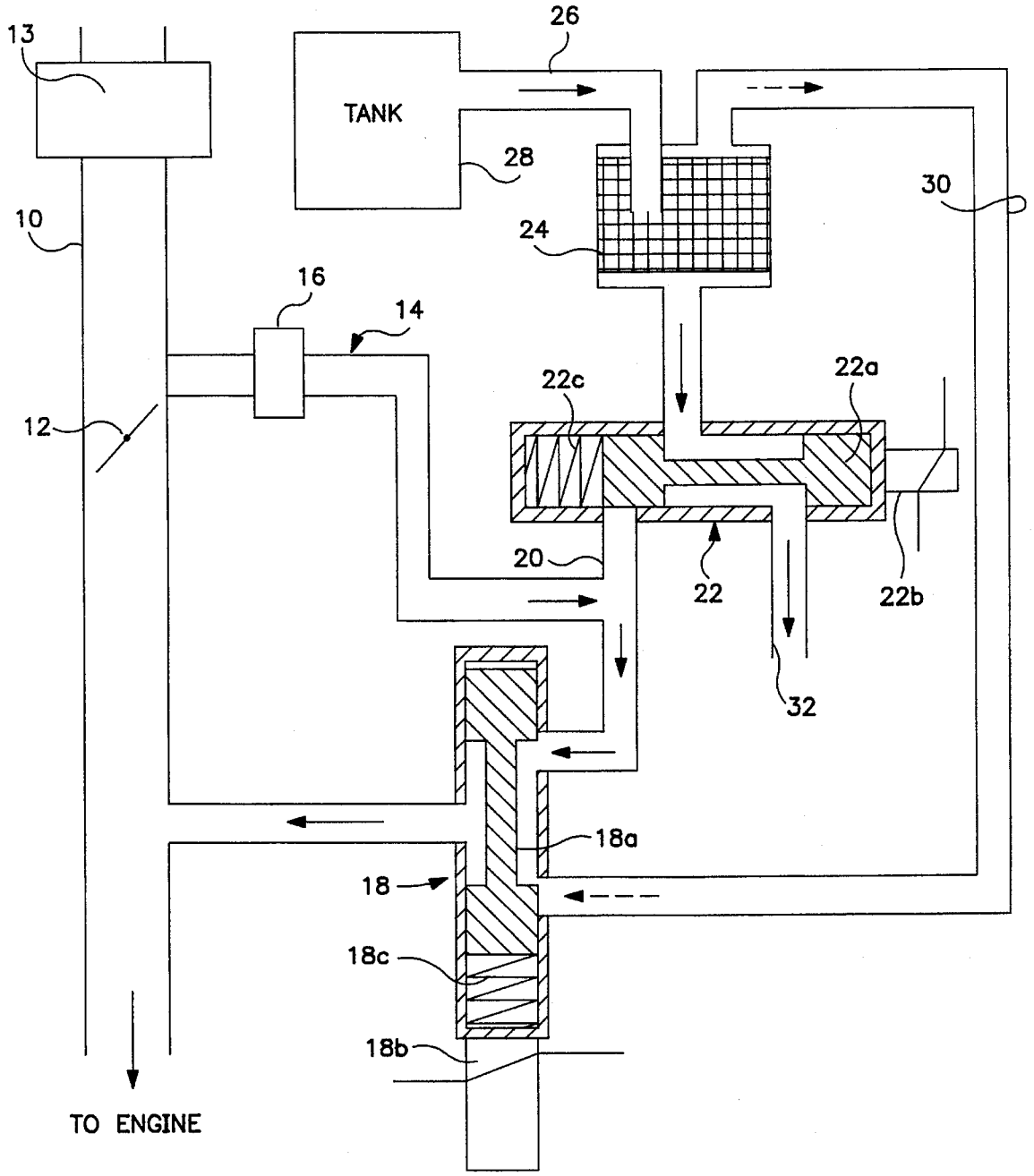

According to FIG. 4 of the drawing, the excitation for the valves 18, 22, can, if required, be changed so that the entire air quantity passing the idling adjuster 16 is conveyed as scavenging air through the adsorption filter 24. In this case, the shut-off valve 22 remains in its position completely opening the conduit 20 to the adsorption filter 24 and completely shutting off the connection to the ventilation orifice 32, whilst the tank ventilation valve 18 shuts off the bypass 14 and completely opens the conduit 30 to the suction pipe 10. On the other hand, according to FIG. 5, there is the possibility, by appropriate change in the exciting currents, to bring the valves 18, 22 or their valve elements 18*a* and 22*a* into such a position that the connection between the bypass 14 and the filter 24 is completely interrupted and the connection to the ventilation orifice 32 is opened completely, this corresponding to the position of rest of the valve 22 in FIG. 2, whilst, on the other hand, the valve 18 is brought into a further intermediate position, in which the second conduit 30 coming from the filter 24 is relatively sharply throttled and the bypass 14 is essentially opened. When there is a high gas content in the tank, some of the air enriched with fuel vapors can thereby be diverted from the tank into the environment after filtration in the adsorption filter 24, whilst another partial airstream, which can contain some fuel vapors, is combined by way of the valve 18 with the bypass flow and is conveyed into the suction pipe 10. At the same time, the valve positions for the operating states according to FIGS. 3 to 5 can be controlled in dependence on signals generated by means of sensors which, for example, record the internal pressure in the tank, the composition of the waste air at the orifice 32 and the fuel concentration in the second conduit 30 leading back to the valve 18, in order, if appropriate in conjunction with other operating parameters, to ensure that the small waste-air quantity, which is additionally introduced into the suction pipe in the operating state according to FIG. 5, and its fuel component do not impair the set or desired operating conditions for the internal-combustion engine.

Figure 6:
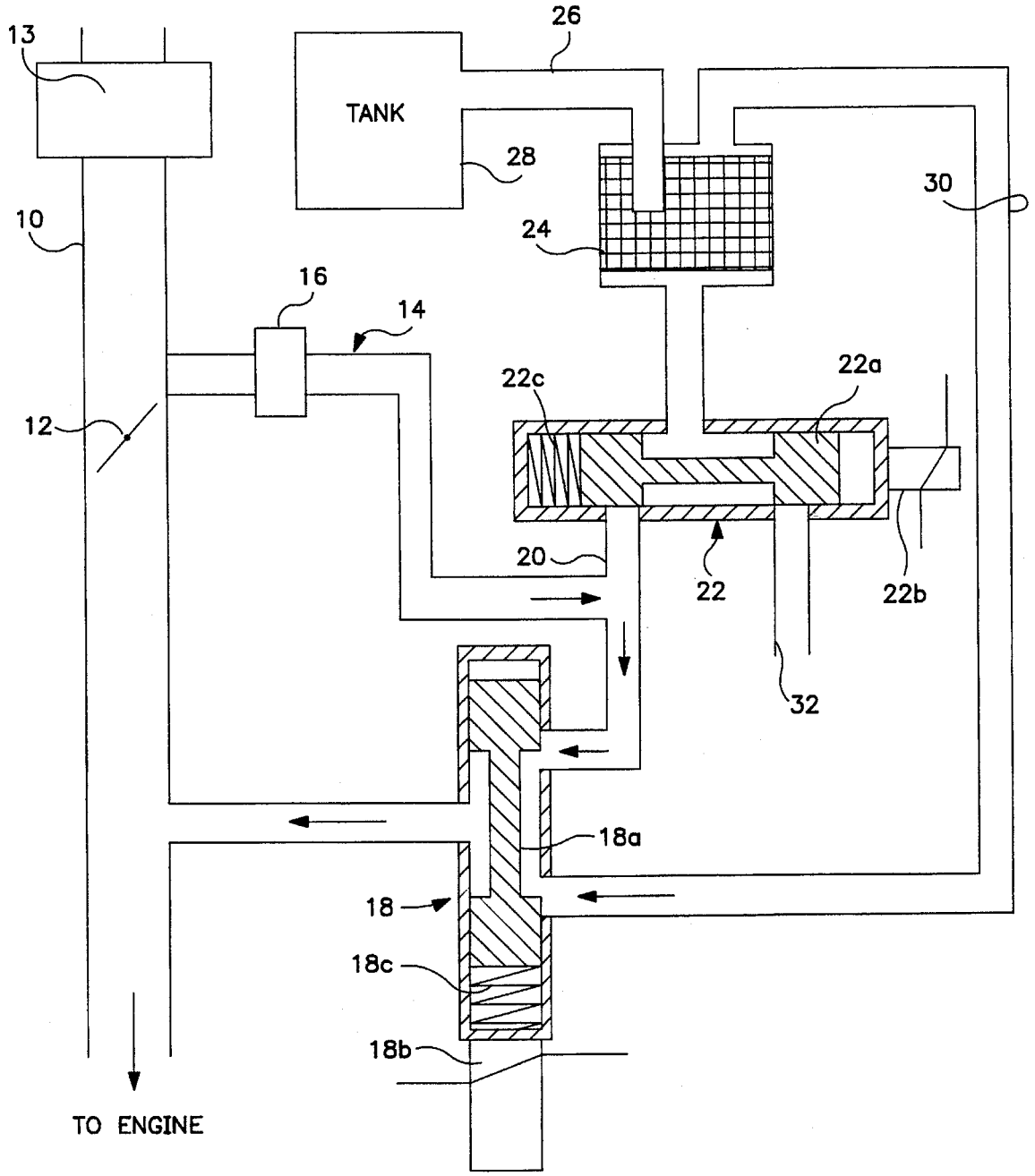
Figure 7:
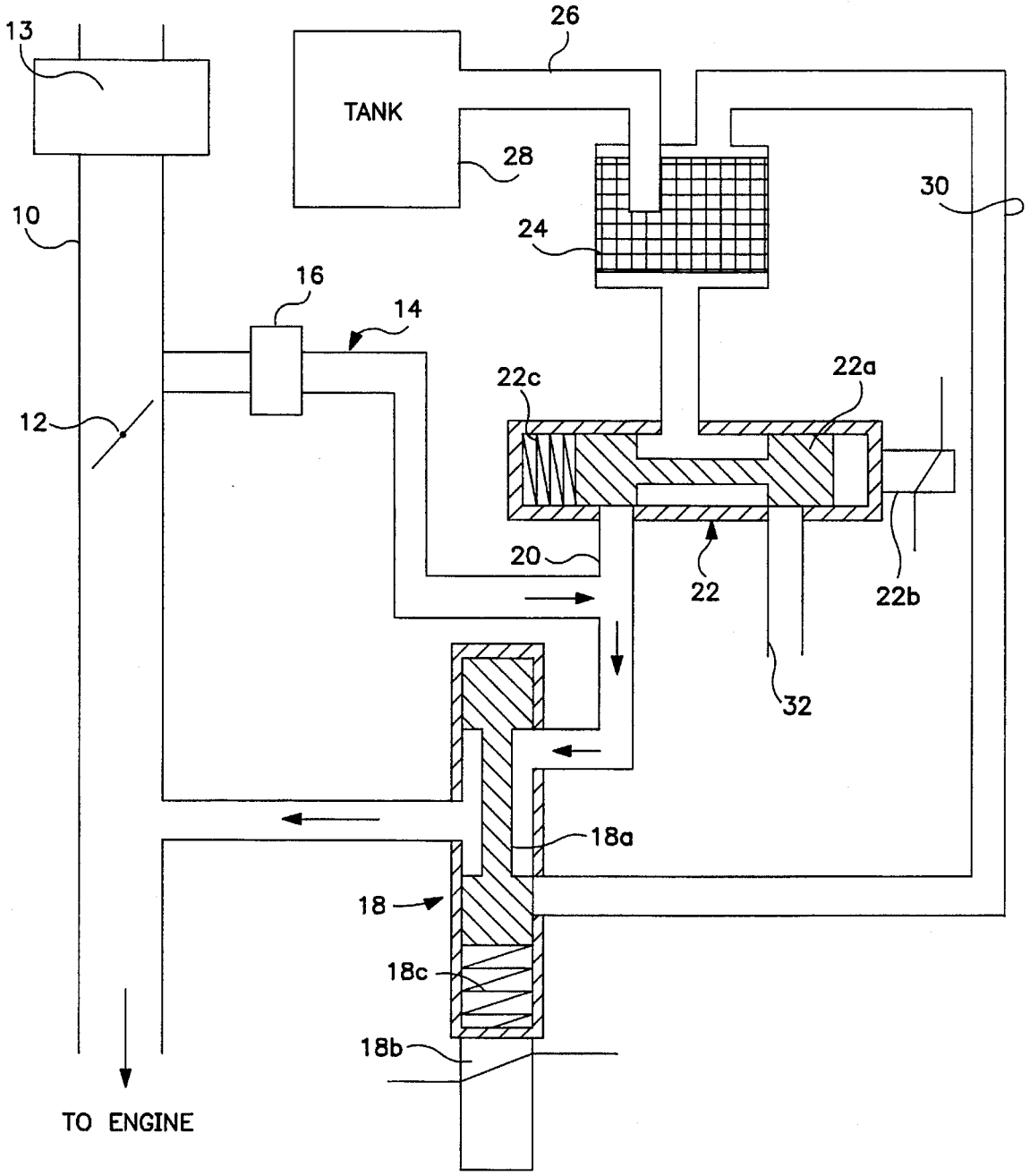

When the valve 18 is brought into an intermediate position, in which it makes a connection between the suction pipe and the conduit 30 and shuts off the bypass 14, whilst at the same time the valve 22 is brought into an intermediate position, in which it interrupts the connection of the tank 28 and filter 24 both to the bypass 14 and to the orifice 32, as shown in FIG. 6, then, to check the operating capacity of the system, there is the possibility of generating the necessary negative pressure in the tank 28 for conducting a check of negative pressure in dependence on the intake pressure in the suction pipe 10. If, starting from the valve positions according to FIG. 6, the valve 18 is brought into the currentless state and shuts off the conduit 30, then, according to FIG. 7, there is, furthermore, the possibility, by the use of suitable devices not shown in the drawing, to generate an overpressure in the tank 28 and to conduct a check of overpressure in the system. These checks can take place in the way known, for example, from DE-40,03,751,A1.

As becomes clear from the explanation above, particularly of the various operating states, by means of the drawings, the method according to the invention and the tank ventilation system for carrying it out afford the possibility of producing a scavenging-air flow for the regeneration of an adsorption filter, without impairing the operating parameters for an internal-combustion engine, the only necessity being to design the already conventionally present valves for shutting off the tank connection and for ventilating the tank as controllable valves. At the same time, the use of these valves also allows a check of negative pressure and a check of overpressure in the tank and in the associated parts of the fuel-supply system.

If the idling control of the internal-combustion engine takes place by means of a varying opening of the throttle flap, then, in a modification of the invention, there is also provided for the throttle flap 12 a bypass 14, the cross-section of which is, however, not changed by an idling adjuster and to which, however, the conduit 20 and 30 as well as the valves 18, 22 are connected in the way described in relation to FIGS. 1 to 7. The functions and advantages described in relation to FIGS. 1 to 7 also apply to an embodiment of this type with a bypass 14 around the throttle flap 12, without an idling adjuster in the bypass 14 and with idling control by varying the opening of the throttle flap 12.

The foregoing relates to preferred exemplary embodiments of the invention, it being understood that other variants and embodiments thereof are possible within the spirit and scope of the invention, the latter being defined by the appended claims.

We claim:

1. A method for the ventilation of a fuel tank of a motor vehicle having an internal combustion engine which has a suction pipe with an air meter and has a by-pass line which leads around a throttle member and an idling adjuster in said by-pass line which comprises directing fuel vapors from said fuel tank to an adsorption filter, controlling a scavenging air-flow from said by-pass to said adsorption filter, controlling a flow of fuel vapors from said adsorption filter to the atmosphere, controlling a flow of air via said by-pass line to said suction pipe downstream of said throttle member and controlling a scavenging air-flow from said adsorption filter to said by-pass line.

2. A method as set forth in claim 1, which includes throttling the scavenging air-flow during periods of a high fuel vapor content in said fuel tank.

3. A fuel tank ventilation system for an internal-combustion engine of a motor vehicle having an air suction pipe (10), a throttle flap (12) in said air suction pipe, an air meter (13) in said air suction pipe upstream of said throttle flap comprising a by-pass line (14) in parallel with said throttle flap, an idling adjuster (16) in said by-pass line, an adsorption filter (24), a connecting conduit (26) connected between said fuel tank and said adsorption filter, a shut-off valve 22 in said flow connection between said adsorption filter and the atmosphere, a scavenging air flow connection (20) from said by-pass line to said shut-off valve, a connection from said adsorption filter to the atmosphere and a tank ventilation valve (18) in said by-pass line downstream of said scavenging air flow connection (20) to which a scavenging air flow connection (30) that is connected to said adsorption filter is connected and controlled by said tank ventilation valve (18).

4. The tank ventilation system according to claim 3, wherein the scavenging conduit (20) leading from the bypass (14) to the adsorption filter (24) is controlled by the shut-off valve (22).

5. The tank ventilation system according to claim 4, wherein the scavenging conduit (20) branches off between the idling adjuster (16) and the tank ventilation valve (18) and said tank ventilation valve (18) likewise controls the bypass (14).

6. The tank ventilation system according to claim 3, wherein the scavenging conduit (20) and the connection to the atmosphere can be shut-off at the same time by means of the shut-off valve (22).

7. The tank ventilation system according to claim 4, wherein the scavenging conduit (20) and the connection to the atmosphere can be shut-off at the same time by means of the shut-off valve (22).

8. The tank ventilation system according to claim 5, wherein the scavenging conduit (20) and the connection to the atmosphere can be shut-off at the same time by means of the shut-off valve (22).

* * * * *